US005389921A

United States Patent [19]

Whitton et al.

[11] Patent Number: 5,389,921

[45] Date of Patent: Feb. 14, 1995

[54] PARKING LOT APPARATUS AND METHOD

[76] Inventors: John M. Whitton, 1845 Sashabaw Rd., Ortonville, Mich. 48462; Robert E. Whitton, 10181 Perry Lake Rd., Clarkston, Mich. 48348

[21] Appl. No.: 61,547

[22] Filed: May 17, 1993

[51] Int. Cl.[6] ..... G08G 1/01

[52] U.S. Cl. ..... 340/933; 340/908.1; 340/932.2; 340/940; 364/347; 248/75; 248/156; 377/9; 377/20; 377/32

[58] Field of Search ..... 340/933, 908, 908.1, 340/932.2, 934, 940; 364/437; 248/75, 156; 377/9, 20, 32

[56] References Cited

U.S. PATENT DOCUMENTS

| | | | |
|---|---|---|---|
| 2,547,937 | 4/1951 | Hall . | |
| 2,880,405 | 3/1959 | Lerman | 340/908.1 |
| 3,132,624 | 5/1964 | Shoemaker | 340/908.1 |
| 3,707,264 | 12/1972 | Trigg et al. | 235/99 A |
| 3,732,842 | 5/1973 | Vara, Sr. | 340/908.1 |
| 3,883,102 | 3/1975 | Trigg | 248/75 |
| 3,978,321 | 8/1976 | Doggett | 340/933 |
| 4,064,555 | 12/1977 | Ottenstein | 340/286.06 |
| 4,258,430 | 3/1981 | Tyburski | 364/920 |
| 4,392,119 | 7/1983 | Price et al. | 340/941 |
| 4,713,910 | 12/1987 | Quante | 340/908 |
| 4,772,869 | 9/1988 | Grammas et al. | 116/63 C |

*Primary Examiner*—John K. Peng
*Assistant Examiner*—Nina Tong
*Attorney, Agent, or Firm*—Reising, Ethington, Barnard, Perry & Milton

[57] ABSTRACT

A parking lot traffic control and fee collection system is disclosed for use in stadium type parking lots. A vehicle counter installed in a portable traffic pylon is provided at the entry point for each entrance lane of the parking lot for marking the station of the parking attendant. The vehicle counter is installed in a tamper-proof arrangement and the cumulative count of vehicles is presented on a display device which is viewable without opening the enclosure provided by the pylon. A parking supervisor may read the cumulative count at any time and pick-up the receipts from the parking attendant during or at the completion of the parking process. The amount of the receipts collected is compared with the reading on the display device and discrepancies are noted by the supervisor. The vehicle counter is provided with a tamper-proof reset switch.

8 Claims, 3 Drawing Sheets

PARKING LOT APPARATUS AND METHOD

FIELD OF THE INVENTION

This invention relates to portable parking lot apparatus and a method of parking fee accountability; more particularly, it relates to a combined portable pylon and a vehicle counter for parking lots having individual vehicle controlled entry and mass exit from the parking lot.

BACKGROUND OF THE INVENTION

In parking lots of the open-lot type, such as those adjacent sports arenas, the management of vehicle parking for an event poses special problems. Typically, the parking lot must accommodate a very large number of cars which will arrive for parking over a time interval prior to the event with a more or less steady traffic flow. However, when the event ends, most of the vehicles are ready to exit at the same time and the exit traffic pattern must accommodate a much higher traffic density to avoid a time consuming traffic jam. It is necessary to provide a controlled flow of incoming traffic on a car-to-car basis for collection of parking fees but, of course, such traffic flow control is not needed for emptying the parking lot.

It is common practice in such parking lots to avoid the use of permanent structures for traffic control or for other purposes which would impede the out flow of traffic from the parking lot. However, traffic lanes must be established for the in-flow of traffic and it is known, for this purpose, to use portable temporary traffic lane markers to define entrance lanes to the lot. Typically, for a large lot, several single-car traffic lanes are established by portable temporary traffic markers and a parking attendant is stationed at an entry point adjacent each lane for the collection of the parking fee.

Because of the relatively large number of parking attendants required for a single event and the need to move the vehicles quickly into the parking lot, it is difficult to maintain supervisory control over the collection of parking fees. Further, because of the large amounts of cash which are collected in a short time period it may be desirable to remove it from the custody of the parking attendants from time-to-time during the in-flow of arriving traffic. Further, there is a need to verify that the amount of the fees which are collected corresponds with the number of vehicles which pass the parking attendant's station because the circumstances provide opportunity for parking attendants to steal some of the cash fees collected and to admit friends or relatives without collecting the proper fee.

There is a need for improvements in the parking arrangement in open-lot type parking lots which will facilitate the controlled entry of for orderliness of parking and fee collection and also permit mass vehicle exit. There is a need for apparatus to enforce accountability for the collection of parking fees.

In the prior art, the open-lot parking lot system for sports arenas and the like is commonly used with portable temporary traffic markers to form traffic lanes for controlled entry past attendant stations. However, such parking lots do not include apparatus to provide for accountability of parking fee collection by the attendants. The use of traffic counters is, of course, known for use on roads and highways to register the number of vehicles passing the counter. A traffic counter of this type is disclosed in the Hall U.S. Pat. No. 2,547,937 granted Apr. 10, 1951 and in the Trigg et al. U.S. Pat. No. 3,707,264 granted Dec. 26, 1972.

It is also known in the prior art to provide a portable information marker for traffic control in the form of a cone or pylon as disclosed in the Grammis et al. U.S. Pat. No. 4,772,869 granted Sep. 20, 19880. This patent discloses a pylon with an interchangeable unit for displaying different signals or information, such as flashing light units and signs.

Also, in the prior art, it is a common practice to provide vehicle parking structures with an entrance lane having an automatic gate with a counter for registering the number of vehicles entering the structure. Parking structures of this type provide exit lanes for collection of parking fees. The entrance and exit lanes of such structures are established by permanent traffic barriers.

It is also known in the prior art to provide pedestrian traffic control at stadiums and the like by use of turnstiles with counters and an attendant for collecting tickets. These arrangements utilize permanent structures for the entering pedestrian traffic and do not allow mass exit through the same area as used for entry.

A general object of this invention is to provide apparatus and method for open-lot parking lots which provides for controlled entry with parking fee collection and mass exit of the parking lot.

SUMMARY OF THE INVENTION

This invention provides apparatus and method for use with an open-lot type of parking lot for controlled traffic entrance to the parking lot with enforced accountability for parking fee collection during or after the period of vehicle entry and allows mass exit of vehicles through the same area.

This is accomplished by a portable vehicle counter pylon at an entrance lane to the parking lot with a traffic counter including a tamper-proof counter display device enclosed in the pylon for producing a digital display representing the number of vehicle entries whereby amount of fee collections can be verified at any time by reading the display.

In accordance with this invention, a portable traffic pylon is positioned on one side of an entrance lane adjacent the station of a parking attendant and the money collected by the attendant during entry of vehicles to the parking lot is compared with the reading of the digital display for verifying the fee collection for the number of vehicles.

A complete understanding of this invention may be obtained from the description that follows taken with the accompanying drawings.

BEST MODE FOR CARRYING OUT THE INVENTION

Figure 1:
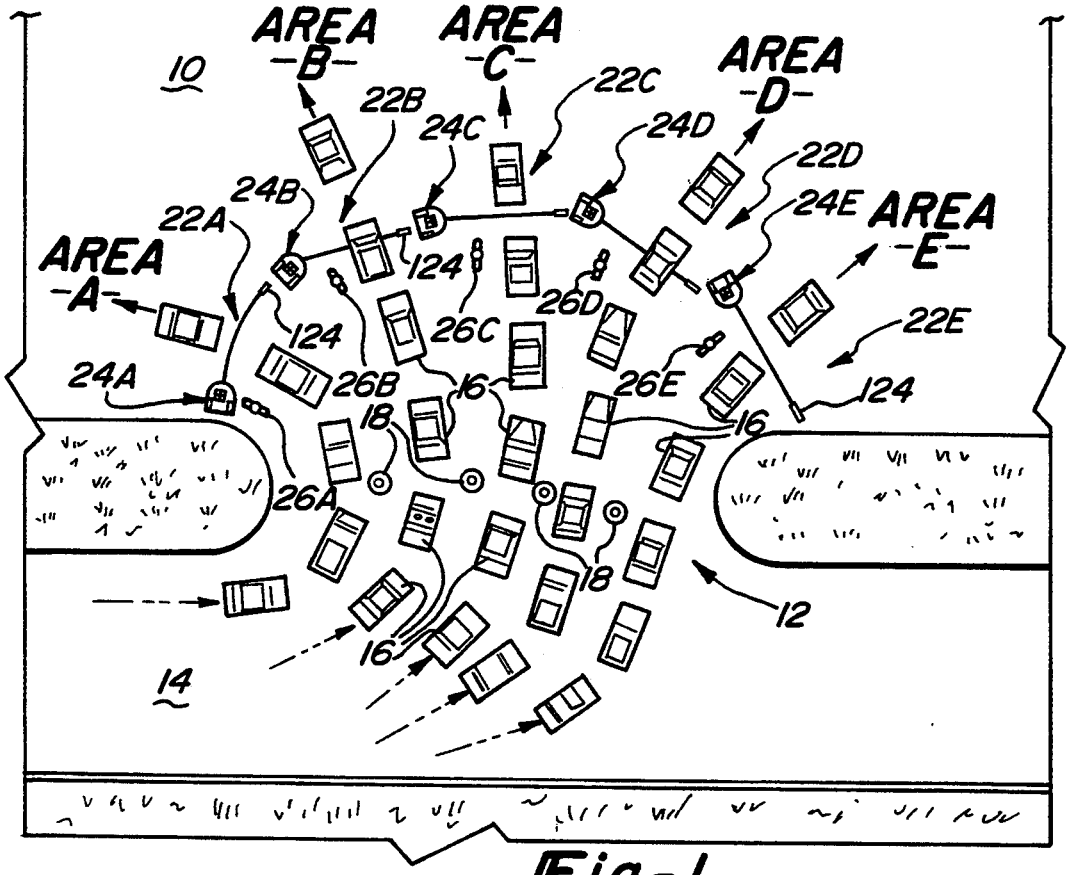
FIG. 1 is a view of a parking lot using this invention for the control of vehicular traffic entering the parking lot.

Referring now to the drawings, there is shown an illustrative embodiment of this invention in a combined vehicle counter and traffic pylon for use in conjunction with parking fee collection in temporary-entrance parking lots such as used at sports arenas. It will be understood, as the description proceeds, that this invention is useful in a variety of applications and may be realized in different embodiments.

In FIG. 1, a parking lot 10 is depicted which is adjacent a sports arena. It is of the type adapted for controlled vehicle entry for parking accommodations during an event in the arena and adapted for mass vehicular exit after the event. The parking lot 10 has a temporary entrance 12 for arriving vehicles which approach the entrance 12 from a multiple lane public thoroughfare 14. The parking lot 10, as is typical of such open lot facilities is sub-divided into different parking areas such areas A through E. The traffic entrance 12 is temporarily arranged to funnel the incoming vehicles into plural single car traffic lanes to facilitate collection of parking fees and routing of the vehicles to a given parking area.

Figure 2:
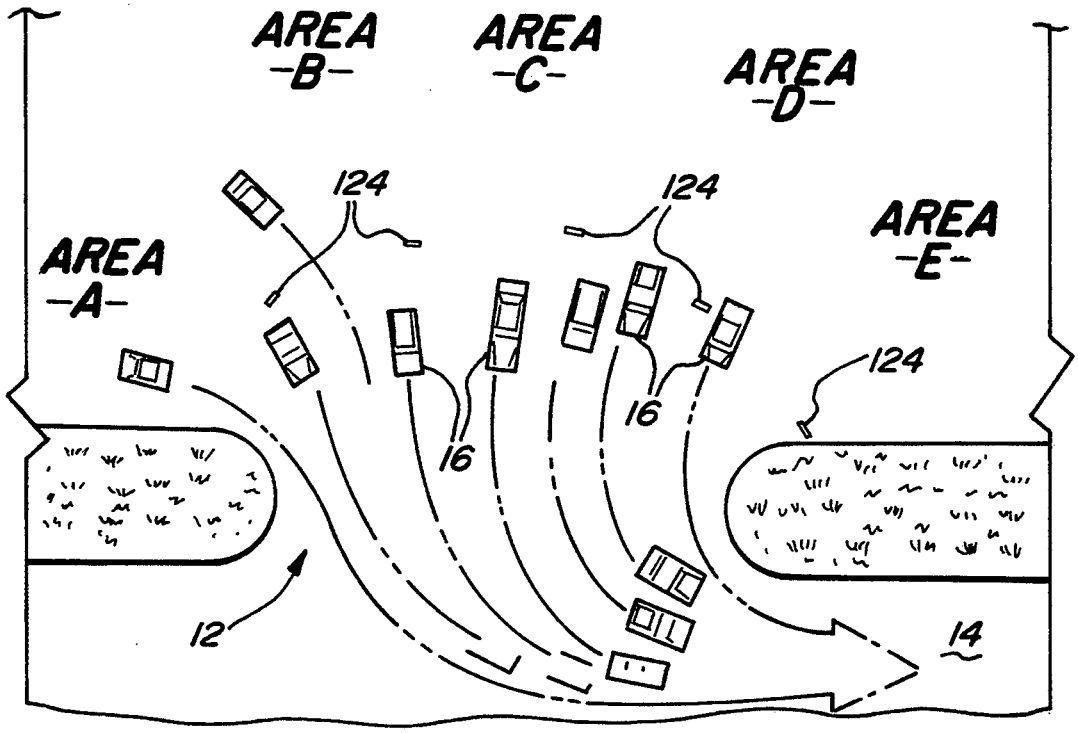
FIG. 2 is a view of the same parking lot showing traffic exiting the parking lot.
Figure 4:
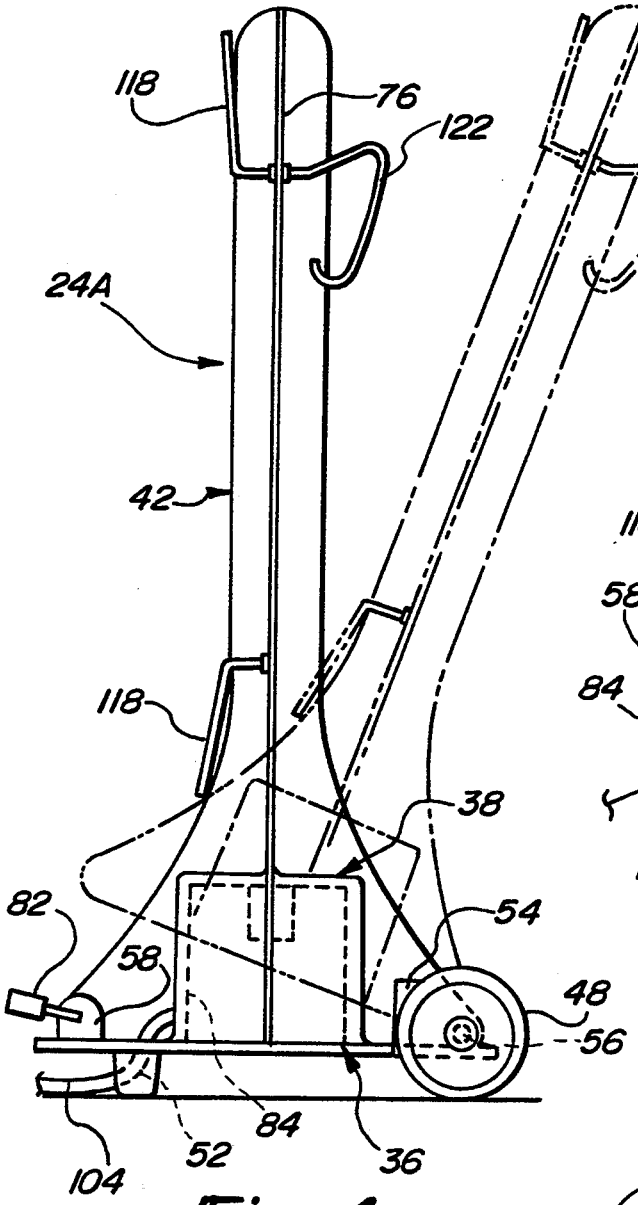
FIG. 4 is a side elevation view of the pylon showing it in its operational upright position and alternately in a tilting position for mobility.

The entrance 12 is herein referred to as a temporary entrance because it serves not only as an entrance for a period of time prior to an event but also as an exit after the event. Further, the temporary entrance utilizes certain portable traffic markers for establishing traffic lanes which are removable to provide unobstructed vehicle exit through the same passageway as that used for entry, after removal of such markers. FIG. 2 shows the same parking lot 10 as that of FIG. 1 with vehicles exiting the parking lot through the same passageway but without the traffic pylons of this invention.

As shown in FIG. 1, the arriving vehicles 16 are formed into single car lanes at the entrance 12 with the aid of traffic cones 18 or other such traffic lane markers. A first lane 20A is routed toward area A past an entrance station 22A. The entrance station 22A includes a vehicle counter pylon 24 of this invention and a parking attendant 26A. Similarly, the entrance lane 20B is routed toward lot B past an entrance station 22B including another vehicle counter pylon 24B and a parking attendant 26B. In a similar manner, entrance lanes 20C, 20D and 20E are provided with separate vehicle counter pylons 24 with parking attendants 26C, 26D and 26E, respectively. The pylons 24 are all of the same construction and will be described in detail below.

The vehicle counter pylon 24 of this invention will now be described in detail with reference to FIGS. 3 through 7. The vehicle counter pylon 24 comprises, in general, a mobile or portable pylon 32 and a vehicle counter 34 which is housed within the pylon. The pylon 32 comprises a base member 36, a cover member 38 which encloses the traffic counter 34, and a tower member 42 which extends upwardly from the base member. Also, the portable pylon 32 includes a sign member 44 which is mounted on the top of the tower member 42.

The base member 36 of the portable pylon 32 comprises a platform 46 which is supported on a pair of wheels 48 and a pair of legs 52. The platform 46 is provided with a pair of vertical flanges adjacent its rear edge and an axle 56 extends transversely of the platform and through the flanges 54 for rotatably mounting the wheels 48. The platform 36 is also provided with a bifurcated staple 58 for a security lock which will be described below. The base member 36 including the parts thereof as described above is suitably constructed of molded plastic in a single piece.

The base member 36 supports the cover member 38 and the tower member 42. The cover member 38 is rectangular in horizontal cross-section with front and rear walls 62 and 64, respectively, and end side walls 66 and 68. It is open at the bottom and has a closed top 70. A vertical flange 72 extends rearwardly from the rear wall 64 of the cover member 38. The flange 72 has a bearing 74 which is rotatably supported on the axle 56 which pivotally supports the cover member 38 along with the tower member 42. The vehicle counter 34 is supported on the platform 46 and when the cover member 38 and the tower member 42 are in the operational position, i.e. with the pylon erect, the cover member 38 covers the vehicle counter 34 to prevent unauthorized access and retains it against unwanted movement.

The tower member 42 is cruciform in horizontal cross-section and comprises a set of four radially extending flanges namely the rear flange 72 and front flange 74, respectively, and a set of side flanges 76 and 78. All four flanges extend from the bottom of the cover member 38 to the top of the tower member 42. When the tower member 42 is in the erect position the lower ends of the flanges rest on the platform 46 and lend lateral stability to the tower member 42. With the tower member 42 erect, the front flange 74 at its lower end is seated between the parts of the bifurcated staple 58. The bifurcated staple 58 and the front flange 74 are provided with aligned holes which are adapted to accept the shackle of a padlock 82. This fastening arrangement provides a security lock to prevent unauthorized access to the vehicle counter 34. The cover member 38 and the tower member 42 are constructed of molded plastic suitably in one piece.

Figure 3:
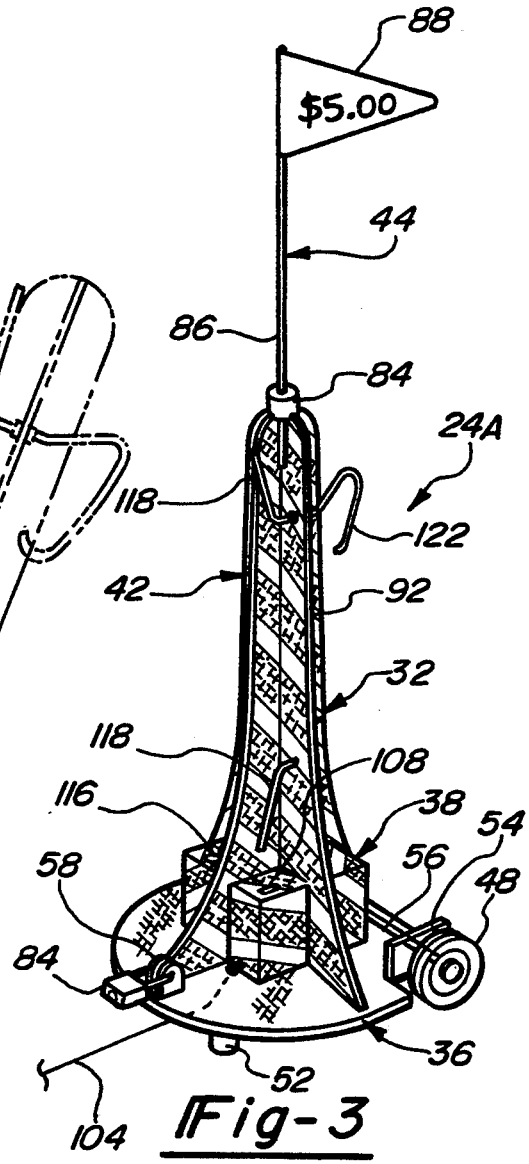
FIG. 3 is a pictorial view of a traffic pylon incorporating this invention.
Figure 7:
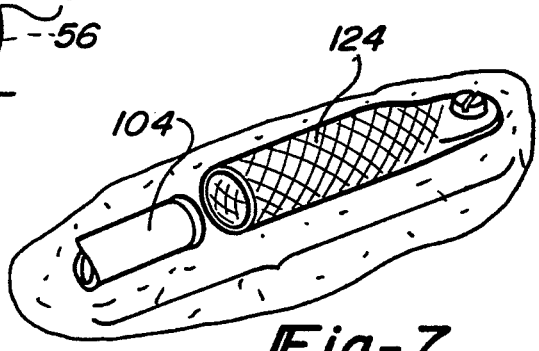
FIG. 7 shows a detail of construction.
Figure 5:
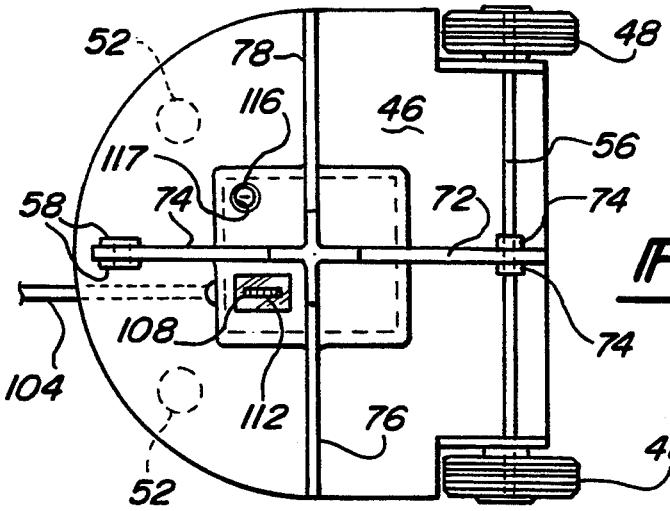
FIG. 5 is a top plan view of the pylon.

In order to gain the attention of vehicle drivers and to display parking information, a changeable sign 44 is provided on top of the tower member 42. The sign 44 comprises a support member 84, a sign pole 86 and a sign 88. The sign support member 84 has the shape of a truncated cone and is provided with a pair of crossed slots 85 on the bottom for mating engagement with the upper ends of the flanges 72, 74, 76 and 78 of the tower member 42. The sign pole 86 is seated in a socket (not shown) on the upper surface of the support member 84. The sign 88 displays information such as the amount of the parking charge. As shown in FIG. 3, strips of luminous or fluorescent adhesive tape 92 are wrapped diagonally around the tower member 42 and the cover member 38 of the portable pylon 32. Thus, the pylon 24 serves as a warning device to the vehicle drivers for the safety of the parking attendant.

Figure 6:
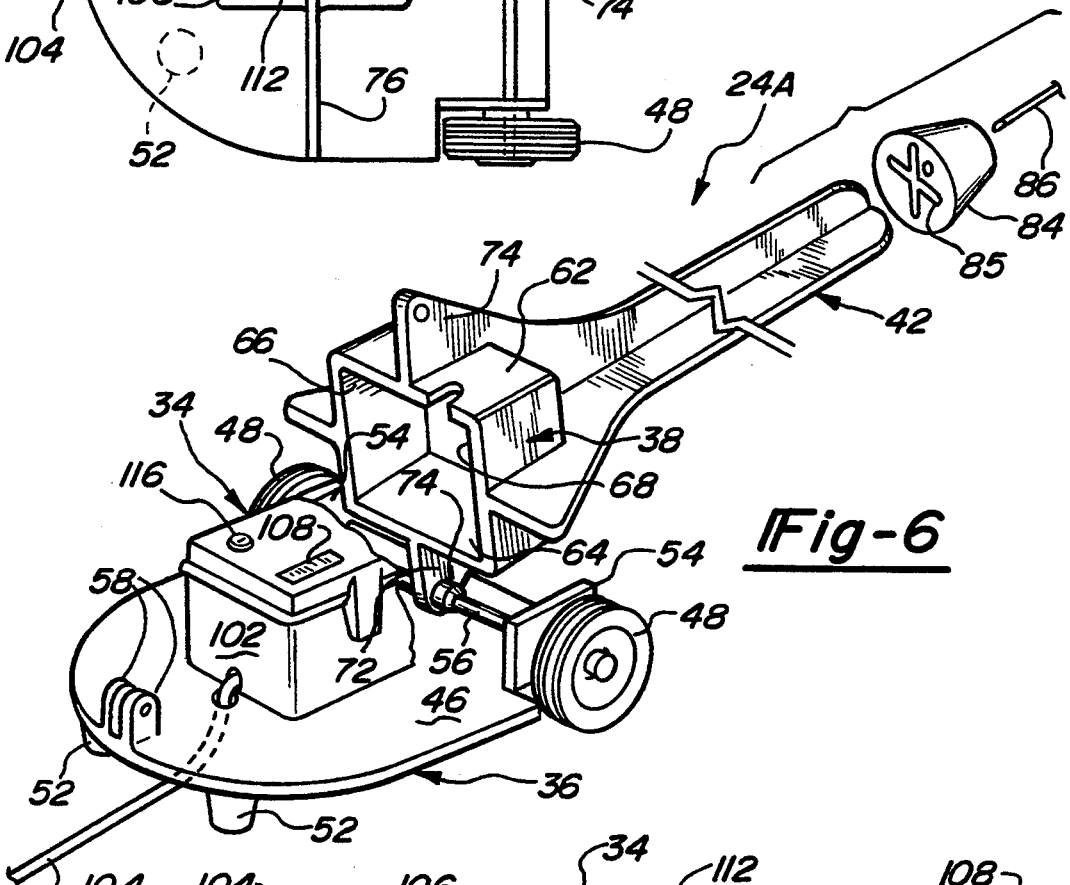
FIG. 6 shows the pylon with the housing open for access to the vehicle counter.

The vehicle counter 34 is of conventional design and is commercially available for traffic counting purposes except for certain special features which will be discussed below. The traffic counter 34 includes a housing 102 which is positioned, as described above, on the platform 46. The vehicle counter 34 in its conventional form includes a vehicle sensor, a counting device and a digital display device. The counting device and the display device are contained within the housing 102. The sensor 104 is an elastic pneumatic tube which has one end coupled with an input fitting on the counting device inside the housing 102. The sensor tube 104, as shown in FIG. 6, extends from the vehicle counter 34 downwardly through the platform 46 and is adapted to lay on the surface of the roadway when the vehicle counter pylon 24 is set up for operation. The other end of the tube 104 is closed and is anchored in the roadway with the tube extending across the traffic lane. The closed end of the tube 104 is preferably secured to the roadway by a tamper-proof fitting such as a quick-disconnect connector in the form of a chinese finger 124.

A pneumatic pressure pulse is produced in response to flattening of the tube by the front set and by the rear set of vehicle wheels when the vehicle passes the parking attendant station. The counting device is set to produce a single count signal in response to each pair of pressure pulses and the count signals are accumulated in a register of the counting device 106 so that the count held by the register represents the number of vehicles which have entered the parking lot through the associated lane. The registered count is presented by the display device so that a person may read the count of vehicles any time. To facilitate the reading, and to bar access by unauthorized persons, the cover member 38 is provided with a window 112 in alignment with the display device inside the housing. The counting device is provided with a conventional reset switch which may be manually actuated to reset the register of the counting device to zero. The conventional reset switch is accessible inside the housing for manual actuation. Preferably, a special reset switch is provided in the form of a key switch 116 located in the top 70 of the housing 102 to make it tamper-proof. The key switch 116 is accessible through an opening 117 in the cover member 38.

When the pylon 24 is not in use, the tube 104 is stored on a pair of tube support brackets 118 which are mounted at the upper and lower ends of the tower member 42. The support brackets 118 are suitably constructed of metal rod secured to the flange 76. For ease of moving the vehicle counter pylon 24 from place-to-place, it is provided with a handle 122 which is mounted at the upper end of the tower member 42 by attachment to the flange 76 and may be formed as an extension of the bracket 118.

Figure 8:
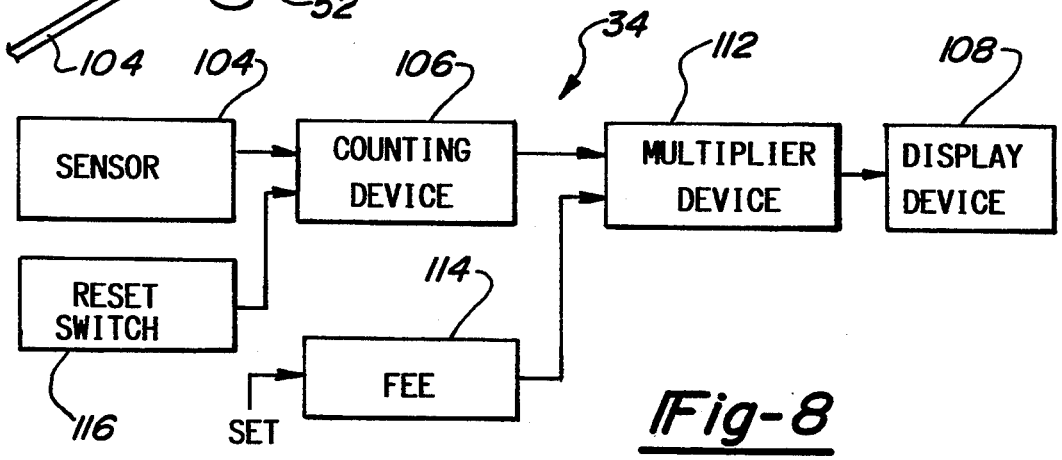
FIG. 8 is a block diagram of the vehicle counter.

As an optional arrangement, it may be desirable to provide a dollar display feature so that the display device 108 shows the cumulative amount of parking fees which should have been collected at any time instead of the number of cars. Such an arrangement is shown in the block diagram of FIG. 8. The sensor 104, a counting device 106 and display device 108 correspond to those described above. In addition, a multiplier device 112 is coupled between the counting device 106 and the display device 108. Also, a fee input device 114 is provided in the vehicle counter and can be set in accordance with the amount of parking fee to be charged for each vehicle. The fee input device 114 provides an output signal representing the fee per vehicle, expressed in dollars, which is applied to an input of the multiplier device 112. The output signal of the counting device 106 representing the cumulative number of vehicles, is applied to the other input of the multiplier device 112. The multiplier device is operative to multiply the fee per vehicle times the number of vehicles and produce a total fee signal which is applied to the input of the display device 108. Accordingly, the display device shows the dollar amount of parking fees which should have been collected at any time.

In accordance with this invention, the vehicle counter pylon 24 is used in a vehicle parking system of an open-lot type of parking lot 10 as shown in FIGS. 1 and 2, in the following manner. In preparation for the arrival of vehicles at the parking lot 10 for an event, the lane marker traffic cones 18 are moved from a storage location into position for establishing single-vehicle entry lanes. Also, the vehicle counter pylons 24 are moved by the parking attendants from a storage location into the lane marking positions as shown in FIG. 1. The traffic counter 34 is readied for operation by placing the sensor tube 104 across the respective entry lane and the free end is inserted into the retaining device 124. The traffic counter 34 is reset to zero, if need be, by actuating the reset switch 116. If the vehicle counter 34 is provided with the dollar display feature of FIG. 8 the fee input device 114 is manually set in accordance with the parking fee to be charged for the event. For example, if the parking fee is five dollars per vehicle it is set accordingly. Additionally, a sign 88 which displays the parking fee of five dollars is used with the pylon 24. With the vehicle counter 34 in readiness for operation, the parking supervisor inspects the traffic counter and places the tower member 42 in the upright position and locks it in place with the padlock 82. The parking attendant is located adjacent the pylon 24 at each entrance lane for collecting the entrance fee or a parking pass from each vehicle.

At random times during the parking process, the supervisor may visit a parking attendant at one of the lanes and take note of the reading on the display device 108. At that time, the supervisor may collect from the parking attendant the money and parking passes which have been received and compare the total with the dollar amount shown by the display device 108. (If the vehicle counter does not have the dollar display feature, the supervisor multiplies the cumulative count times the number of vehicles for comparison with the receipts.) The supervisor notes any discrepancy and gives the parking attendant a receipt for the amount collected and resets the vehicle counter 34 to zero to start a new counting sequence. This accounting procedure may be performed at other times during the parking period and at the end of the parking period to ensure the accountability of the parking attendants for the fees collected. Alternative to the periodic accounting procedures during the parking period as just described, there may be a single accounting procedure for each parking attendant and the vehicle counter pylon after the last vehicle has entered through the associated traffic lane. After the parking process described has been completed, the vehicle counter pylons 24 are removed from the entrance 12 to the storage location. The lane marker cones 18 may also be removed to storage. This leaves the entrance 12 unobstructed and open for mass exit of the vehicles from the parking lot into the public thoroughfare 14, as shown in FIG. 2.

CONCLUSION

A vehicle counter and traffic pylon, in combination, and a method of use in an open-lot parking system have been described. The invention provides for controlled entry of vehicles for orderly parking and fee collection with full accountability for the receipts by each parking attendant.

Although the description of this invention has been given with reference to a particular embodiment, it is not to be construed in a limiting sense. Many variations and modifications will now occur to those skilled in the art. For a definition of the invention, reference is made to the appended claims.

What is claimed is:

1. A vehicle counting system for a vehicle parking lot having an entrance lane for allowing vehicles entry and entrance fee collection for each of said vehicles by a parking attendant, said system comprising:

a portable traffic pylon at one side of said entrance lane, said pylon including a base member, a vehicle counter mounted on said base member adapted to sense and count said vehicles passing thereby, said pylon further including a tower and a counter cover attached to the bottom of the tower pivotally mounted on said base member adapted to be pivoted from a normal upright position where said tower serves to guide vehicle traffic and said counter cover encloses said vehicle counter to a tilted access position where access to said vehicle counter is allowed between said base member and counter cover, said vehicle counter having a display device for producing a digital display which represents the number of vehicles counted by the vehicle counter, said counter cover having an opening to permit viewing of said digital display from outside the pylon, a security lock for normally locking said tower and counter cover to said base member in said upright position, whereby the amount of fee collection to be accounted for by the attendant can be verified at any time by reading of said display and said tower and counter cover are normally locked in said upright position to operate as said traffic pylon while preventing unauthorized access to said vehicle counter, said base member having at least one leg to aid in supporting said pylon in a stationary position, an axle mounted on said base member, a pair of wheels mounted on said axle for use in moving said pylon and for cooperating with said one leg to support said pylon in a stationary position, and said tower and counter cover pivotally mounted on said base member by said axle.

2. The vehicle counting system as defined in claim 1 wherein:

said vehicle counter comprises a vehicle sensor responsive to said vehicles passing said sensor for producing a vehicle entry signal for each of said vehicles, a signal counter having an input coupled with said sensor for counting each of said vehicle entry signals and having an output coupled to said display device.

3. The vehicle counting system as defined in claim 1 wherein:

a pneumatic sensor tube is operatively connected to said vehicle counter, said pneumatic sensor tube having a closed end and adapted to be laid across a roadway for generating a pneumatic pulse in response to compression by a vehicle wheel, said vehicle counter having a pneumatic inlet for receiving said pneumatic pressure pulse from the tube, and a tube retainer adapted to be secured to the roadway and receive the closed end of said tube to prevent unauthorized removal of the tube from the roadway.

4. The vehicle counting system as defined in claim 3 including:

a handle on said tower for tilting said pylon so that it is wholly supported on said wheels for movement, and a pair of spaced brackets on said tower for supporting the tube during movement of said pylon.

5. The vehicle counting system as defined in claim 1 including:

a sign pole mounted on said tower and extending above said tower when said tower is in said upright position, and a sign is supported by said pole.

6. The vehicle counting system as defined in claim 1 including:

a multiplier device coupled with the output of said signal counter for multiplying the counter signal by the parking fee per vehicle to produce a dollar signal, said display device receiving said dollar signal for displaying a cumulative dollar amount of parking fees for the number of vehicles counted.

7. The vehicle counting system as defined in claim 1 including:

said tower and counter cover pivotally mounted on said base by said axle at a single location between said wheels.

8. The vehicle counting system as defined in claim 1 wherein:

said signal counter includes a reset device, and a security device operatively associated with said reset device to prevent unauthorized resetting of said signal counter and an opening in said counter cover for providing access to said reset device.

* * * * *